US009504098B2

(12) United States Patent
Peelamedu

(10) Patent No.: US 9,504,098 B2
(45) Date of Patent: Nov. 22, 2016

(54) FURNACE SYSTEM HAVING HYBRID MICROWAVE AND RADIANT HEATING

(71) Applicant: BTU International, Inc., No. Billerica, MA (US)

(72) Inventor: Ramesh D. Peelamedu, Andover, MA (US)

(73) Assignee: BTU International, Inc., North Billerica, MA (US)

( * ) Notice: Subject to any disclaimer, the term of this patent is extended or adjusted under 35 U.S.C. 154(b) by 540 days.

(21) Appl. No.: 14/047,172

(22) Filed: Oct. 7, 2013

(65) Prior Publication Data

US 2014/0103031 A1 Apr. 17, 2014

Related U.S. Application Data

(60) Provisional application No. 61/712,444, filed on Oct. 11, 2012.

(51) Int. Cl.
*H05B 6/64* (2006.01)
*H05B 6/78* (2006.01)

(52) U.S. Cl.
CPC ..... *H05B 6/6482* (2013.01); *H05B 6/645* (2013.01); *H05B 6/6491* (2013.01); *H05B 6/78* (2013.01)

(58) Field of Classification Search
CPC ..... H05B 6/6482; H05B 6/645; H05B 6/78; H05B 6/6491; A23L 3/0055; A23L 3/01; A23L 3/40; A23L 3/0155; F26B 5/048; F26B 5/041
USPC ..... 219/700, 684, 698, 701, 710, 712, 716, 219/730, 749, 759, 751, 702; 422/22, 1, 24, 422/292, 300, 186
See application file for complete search history.

(56) References Cited

U.S. PATENT DOCUMENTS 4,803,324 A 2/1989 Fujii et al.
5,020,237 A * 6/1991 Gross ..... A23L 3/0055 219/685

(Continued)

FOREIGN PATENT DOCUMENTS

CN 1313479 A 9/2001
CN 1771765 A 5/2006

(Continued)

OTHER PUBLICATIONS

Translation of JP2007037467A, Kuriyama et al., Stbilizer for oil and fat crystal,Feb. 15, 2007, http://worldwide.espacenet.com/publicationDetails.*

*Primary Examiner* — Quang Van
(74) *Attorney, Agent, or Firm* — Preti Flaherty Beliveau & Pachios LLP

(57) ABSTRACT

A furnace system for thermal processing of products and materials is disclosed which is particularly useful in processing touch screens for computer tablets and silicon wafers employed in fabricating solar cells. The system employs a hybrid of microwave and radiant heating of workpieces to provide controlled heating of the workpieces. A plurality of susceptors are disposed a furnace chamber. A plurality of microwave sources are arranged to provide microwave radiation in the chamber to uniformly heat workpieces in the chamber and to provide uniform heating of the susceptors. The susceptors are effective upon microwave heating by the microwave sources to provide uniform radiant heating of the workpieces in the chamber.

12 Claims, 11 Drawing Sheets

(56) References Cited

U.S. PATENT DOCUMENTS

| | | | | |
|---|---|---|---|---|
| 6,350,973 | B2 | 2/2002 | Wroe et al. | |
| 7,507,369 | B2 | 3/2009 | Lu | |
| 7,687,045 | B2 | 3/2010 | Lu | |
| 7,939,016 | B2 | 5/2011 | Lu | |
| 8,431,878 | B2 * | 4/2013 | Dunn | H05B 6/78 219/700 |
| 2003/0057204 | A1 | 3/2003 | Minobe et al. | |
| 2003/0132227 | A1 | 7/2003 | Geisler | |
| 2006/0054618 | A1 * | 3/2006 | Agrawal | B01J 19/126 219/679 |
| 2008/0207008 | A1 | 8/2008 | Peelamedu et al. | |

FOREIGN PATENT DOCUMENTS

| | | | | |
|---|---|---|---|---|
| CN | 1792994 | A | | 6/2006 |
| JP | 2007037467 | A | * | 2/2007 |
| JP | 2011125258 | A | | 6/2011 |
| JP | 2012082485 | A | | 4/2012 |
| WO | WO 2012/048284 | | | 4/2012 |

* cited by examiner

Section A-A

Section A-A

Section B-B

FURNACE SYSTEM HAVING HYBRID MICROWAVE AND RADIANT HEATING

CROSS REFERENCE TO RELATED APPLICATIONS

This application claims the benefit under 35 U.S.C. §119 (3) of U.S. Provisional Patent Application No. 61/712,444, entitled "Furnace System Having Hybrid Microwave and Radiant Heating" filed Oct. 11, 2012 which is herein incorporated by reference in its entirety for all purposes.

STATEMENT REGARDING FEDERALLY SPONSORED RESEARCH OR DEVELOPMENT

N/A

BACKGROUND OF THE INVENTION

For the thermal processing of products and materials, there is often a need for rapid and uniformly heating of the product or the material without causing thermal stress which can damage the product or material being processed. Products such as touch screens used for computer tablets, silicon wafers employed in fabricating solar cells and sintered ceramics are especially prone to thermal stress if heated in a manner which is not properly managed.

BRIEF SUMMARY OF THE INVENTION

A furnace system and method for thermal processing of products and materials is disclosed. The system and method are particularly useful for example in processing touch screens for computer tablets, silicon wafers employed in fabricating solar cells, glass coatings, sintered ceramics and carbon fiber structures. Another exemplary use is in diffusing phosphorous or boron into semiconductor wafers as part of a solar cell or panel fabrication process. The invention is not limited to such uses but is more broadly applicable to the thermal processing of workpieces and materials where rapid and uniform heating in a controlled manner is desirable.

The system employs a hybrid of microwave and radiant heating of workpieces to provide controlled heating of the workpieces. In one embodiment, the system includes an insulated furnace housing having an inlet end and an outlet end and having a furnace chamber within the housing which may be divided into one or more zones. A conveyor assembly is provided for transporting workpieces through the furnace chamber from the inlet end to the outlet end. A plurality of susceptors are disposed in the chamber in at least one zone thereof, the susceptors being positioned above the conveyor to define a chamber through which the workpieces are transported. A plurality of microwave sources are arranged to provide microwave radiation in the chamber to uniformly heat the workpieces transported through the chamber by the conveyor and to provide uniform heating of the plurality of susceptors. At temperatures greater than about 600°, the susceptors are effective upon microwave heating by the plurality of microwave sources to provide uniform radiant heating of the workpieces being transported through the chamber.

The susceptors in a preferred embodiment comprise a plurality of rods each composed of high temperature high purity composite ceramic material, the rods being disposed in spaced relation across the width of the chamber in at least one zone of the chamber and positioned to receive microwave radiation from the plurality of microwave sources and to provide radiant energy to the workpieces being transported through the chamber. The susceptor rods can be varied in number and in spacing in order to adjust the power levels and heat profiles suitable for the particular workpieces being processed in the furnace.

The power per unit volume of the susceptors is determined to provide an intended amount of microwave absorption by the susceptors in order to absorb sufficient microwave energy for heating of the susceptors and emission of radiant energy onto the workpieces or product.

For lower operating temperatures, typically less than about 600°, the susceptors do not produce much radiant heating of the workpieces but serve to provide more uniform microwave heating of the workpieces by control of the microwave field.

Each of the microwave sources is composed of a relatively low power and low cost magnetron coupled to a horn mounted about an aperture in a chamber wall and operative to introduce microwave energy into the chamber. A plurality of such sources are disposed in an array operative to introduce microwave energy through respective apertures in the wall into the chamber. The magnetrons are powered by respective power supplies or, alternatively, by one or more shared power supplies to provide requisite electrical power to the magnetrons. The power to the magnetrons is controllable by associated power controllers for varying the power provided by the respective sources and for switching the respective sources on and off. The number and spacing of sources within the microwave array can be selectively determined, as can the power provided to each of the sources of the array in order to produce an intended power level and/or profile of microwave energy introduced into the furnace chamber.

One or more mode stirrers, which per se are known in the art, are provided in the furnace chamber and are operative to mix the microwave modes to provide more uniform electric field within the chamber. In one preferred embodiment two mode stirrers are employed on respective sidewalls of the chamber.

A microwave choke is provided at the inlet end and outlet end of the furnace to prevent leakage of microwave energy from the furnace to the external environment. Isolators can be employed around any shafts protruding through the furnace wall, such as the shafts of the mode stirrers to prevent leakage of microwave energy.

The system includes a control system for independent control of each of the microwave sources and closed loop control of the temperatures in the furnace chamber. Thermocouples or other temperature sensors are provided in the furnace chamber for monitoring chamber temperature, and an infrared pyrometer or other sensor is employed to measure the temperature of the workpieces being transported through the chamber. Signals from these sensors are provided to the control system and employed to control temperature to maintain an intended workpiece and processing temperature. Different temperatures can be provided in respective zones of a multi-zone furnace to provide an intended thermal profile as the workpieces are conveyed through the zones.

The dielectric characteristics of the workpieces must be taken into account in order to achieve an intended processing profile and degree of control.

The conveyor is made of belt material and construction appropriate for use in a microwave field. For example, the conveyor can employ quartz rollers which are transparent to microwaves. The conveyor belt can also be made of metal and can be electrically grounded since heated metal is less microwave reflective and can be used in the microwave chamber. Other conveyors can be employed such as roller or pusher mechanisms depending upon the nature and weight of the product.

The invention can also be implemented in a batch furnace in which case the conveyor belt and chokes will ordinarily not be necessary. In a batch system a furnace chamber is provided within a suitable housing and a sealed door can be provided for access to the chamber for loading and removal of a product to be processed in the chamber. The door is thermally sealed to minimize heat loss and is also microwave sealed to minimize leakage of microwave energy.

BRIEF DESCRIPTION OF THE SEVERAL VIEWS OF THE DRAWINGS

The invention will be more fully understood from the following detailed description in conjunction with the drawings, in which.

DETAILED DESCRIPTION OF THE INVENTION

This application claims the benefit under 35 U.S.C. §119 (3) of U.S. Provisional Patent Application No. 61/712,444, entitled "Furnace System Having Hybrid Microwave and Radiant Heating" filed Oct. 11, 2012 which is herein incorporated by reference in its entirety for all purposes.

Overall System

Figure 1:
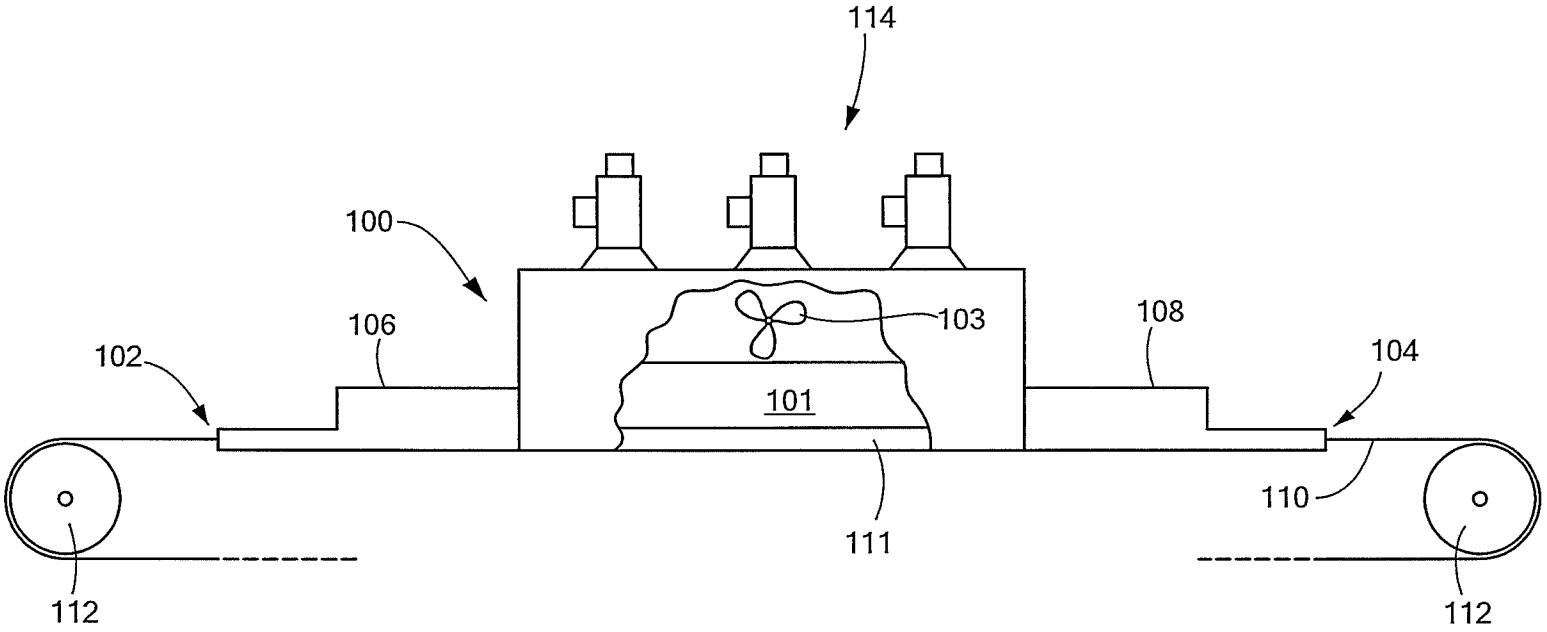
FIG. 1 is a diagrammatic view of a furnace system in accordance with the invention.

An embodiment of a continuous furnace system in accordance with the invention is illustrated diagrammatically in FIG. 1. The system includes a furnace housing 100 having an inlet or entrance end 102 and an outlet or exit end 104. A microwave choke 106 is provided at the entrance end of the furnace, and a microwave choke 108 is provided at the exit end of the furnace. The chokes are identical in construction, and in the illustrated embodiment, are two stage chokes to be further described below. A furnace chamber 111 is provided in the furnace housing and which may be divided into one or more heating zones. A conveyor belt 110 extends through the furnace and the entrance and exit chokes for transporting workpieces through the furnace chamber from the entrance end to the exit end. The conveyor belt is a continuous belt disposed for example on sprockets 112 connected to a suitable conveyor drive mechanism for moving the belt 110 through the furnace at an intended speed. A thermal box 101, to be described below, is disposed in the furnace chamber above the conveyor and contains a plurality of susceptor rods arranged along the length and width of the chamber.

An array 114 of magnetrons are disposed on the top of the furnace housing and are operative to introduce microwave energy from each of the magnetrons of the array into the furnace chamber for microwave heating of the workpieces passing through the chamber on the conveyor belt. The microwave energy from the magnetron array is also operative to heat the susceptors disposed in box 101 in the furnace chamber and which, upon microwave heating, produce radiant energy directed to the workpieces. The susceptors will be described hereinbelow in further detail. In accordance with the invention, the workpieces conveyed through the furnace are heated by a controlled combination of radiant energy from the susceptors and microwave energy from the magnetron array.

The furnace according to the invention is typically operated in a temperature range between about 600° and 1050° C. but the invention can be implemented in furnace constructions operative at higher and lower temperatures.

Magnetron Array

A plurality of microwave sources are arranged to provide uniform microwave radiation in the chamber to uniformly heat the workpieces transported through the chamber by the conveyor and to provide uniform heating of the plurality of susceptor rods. Each low cost magnetron coupled via a tunable waveguide to a horn mounted about an aperture in a furnace wall and operative to introduce microwave energy into the chamber. A plurality of such sources are disposed in an array operative to introduce microwave energy through respective apertures in the furnace wall. In the illustrated embodiment an array of nine microwave sources is provided arranged in a rectangular 3×3 array. The number and placement of magnetrons and associated waveguides and horns is determined to produce a uniform microwave field in the chamber and uniform heating of the susceptors. As an alternative, the relative power of the magnetrons and their spacing and position within an array of magnetrons can be adjusted to produce a desired non-uniform distribution or profile of microwave energy in the chamber.

Figure 2A:
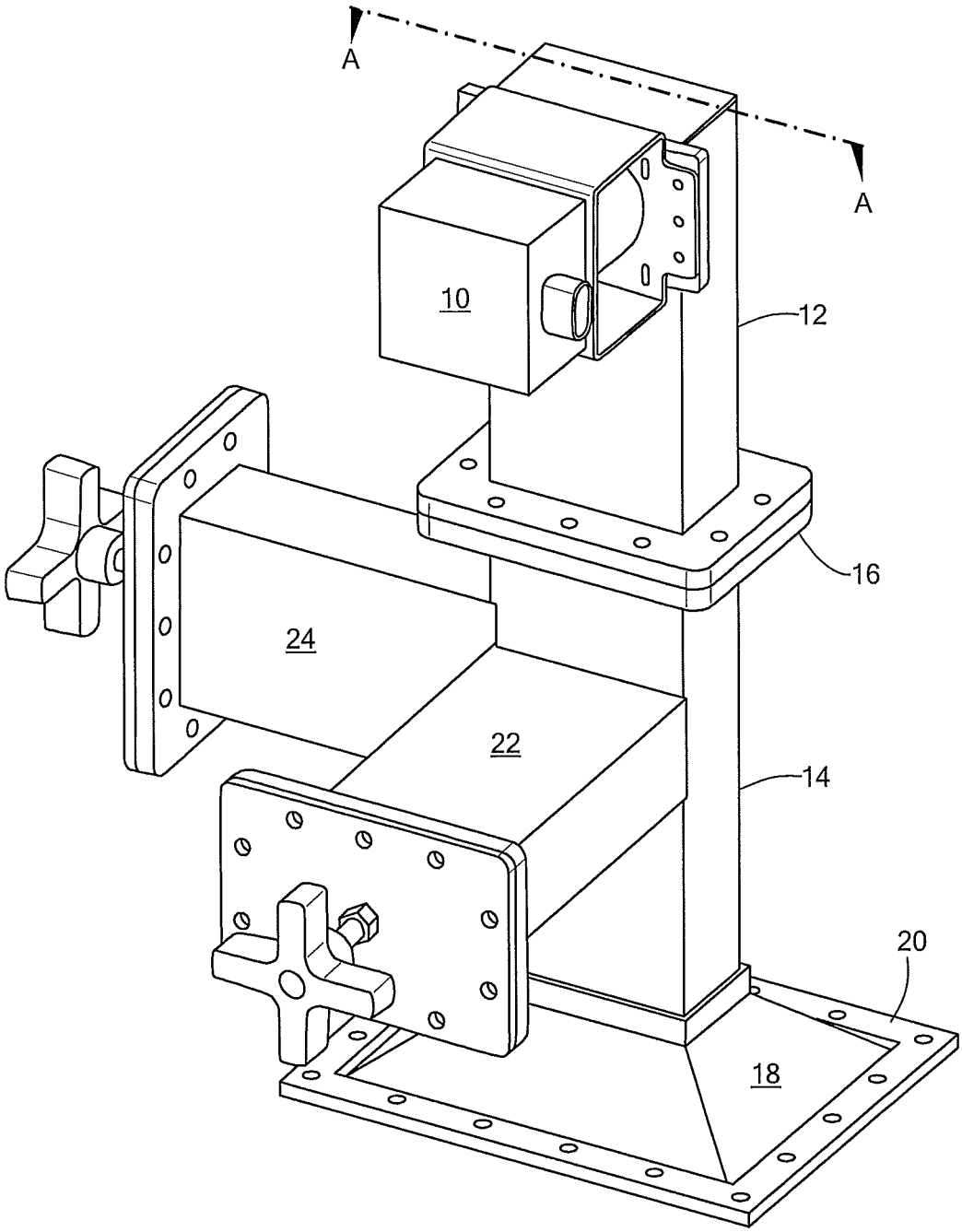
FIG. 2A is a pictorial view of a microwave source in accordance with the invention.
Figure 2B:
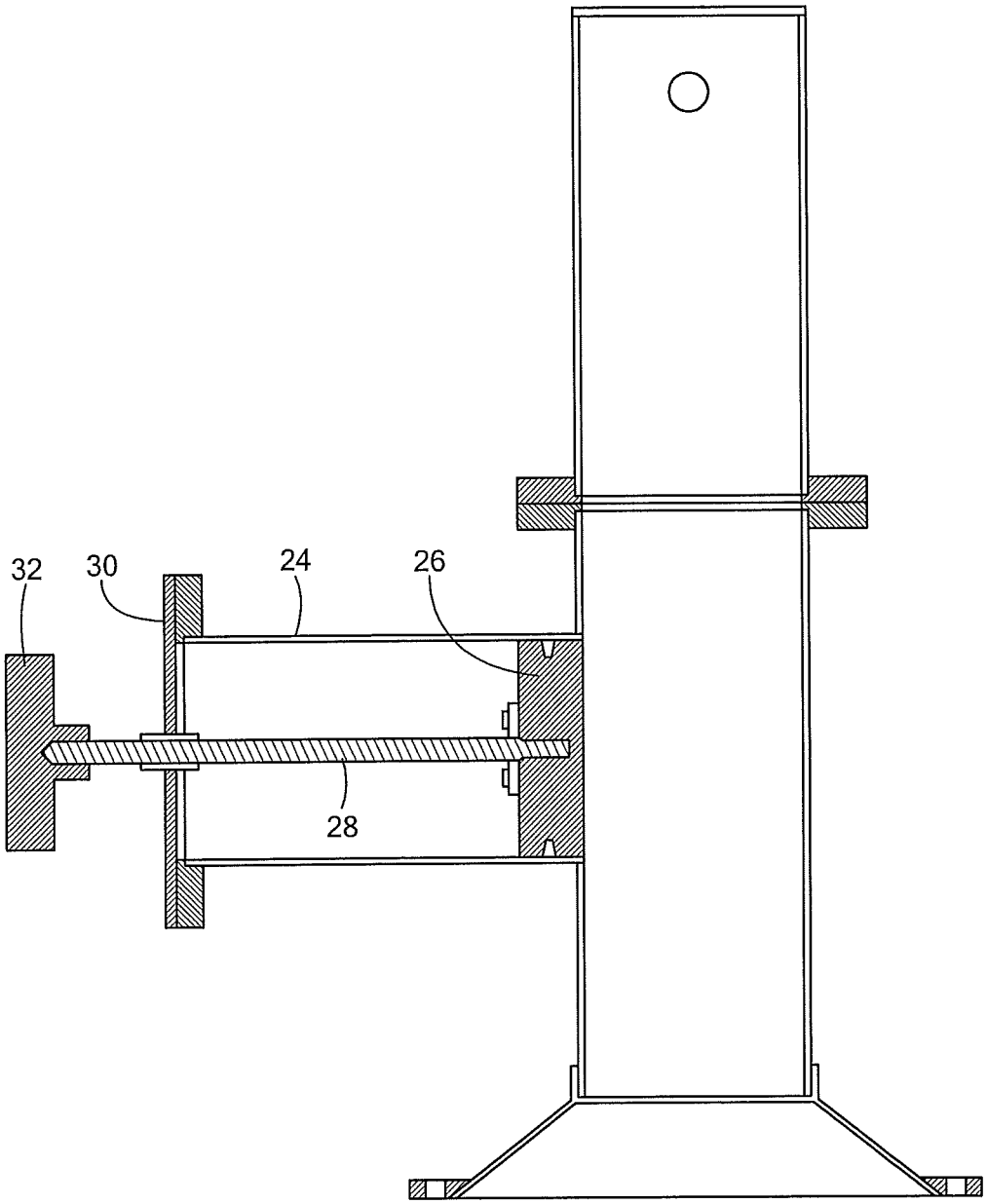
FIG. 2B is a sectional view taken along lines A-A of FIG. 2A.
Figure 3:
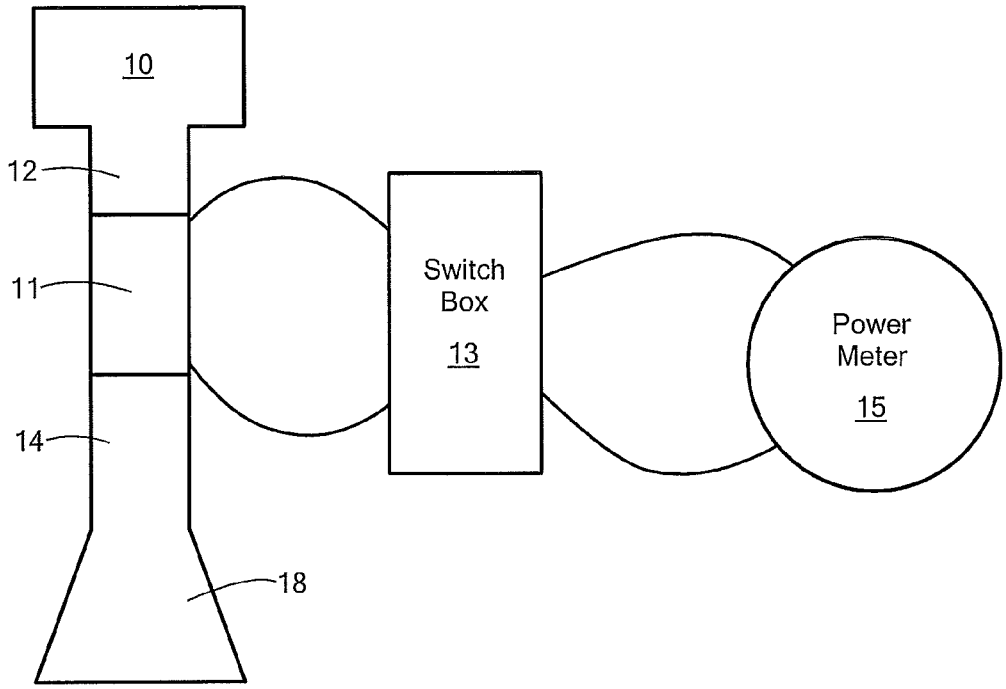
FIG. 3 is a diagrammatic view of monitoring apparatus for the magnetrons of the array.

One of the microwave sources is illustrated in FIGS. 2A and 2B. A magnetron 10 is attached to a waveguide 12 which is attached to a waveguide 14 via a coupling 16. The waveguide 14 is attached to a horn 18 which has a mounting flange 20 attachable to a wall of the furnace by suitable fasteners cooperative with holes in the flange 20 and aligned holes in the furnace wall. A tuning stub 22 is attached to the wider wall of waveguide 14, and a second tuning stub 24 is attached to the narrower wall of waveguide 14. The tuning stubs are each $5\lambda/4$ in length. The tuning stubs 22 and 24 are disposed along the respective transverse axes of the waveguide 14 and are orthogonal to each other. Each of the tuning stubs includes a piston moveable along the length of the respective waveguide stub section. As seen in FIG. 3, a piston 26 is attached to a rod 28 which extends through an opening in an end plate 30 and on the outer end of which is a central knob 32. The knob 32 and connecting rod 28 can be pushed inward and outward to adjust the position of piston 26 along the length of the stub 24. Each stub is tuned to maximize the forward power emanating from horn 18 into the furnace chamber and to minimize the reverse or reflected power back to the magnetron. The pistons can be locked in position after tuning. The waveguides and horn are fabricated of aluminum or other suitable metal. The piston 26 is also fabricated of aluminum or other suitable metal. The piston arrangement for stub 24 illustrated in FIG. 2B is the same for stub 22.

The respective pistons for stubs 22 and 24 are slidable along the respective waveguide inner surfaces and each of the pistons includes a groove around the periphery thereof in which a metal or other conductive mesh gasket, is provided as illustrated in FIG. 2B, which is in contact with the confronting inner walls of the stubs to eliminate or minimize arcing which could occur across the gap between the wall and confronting piston surface.

Figure 4:
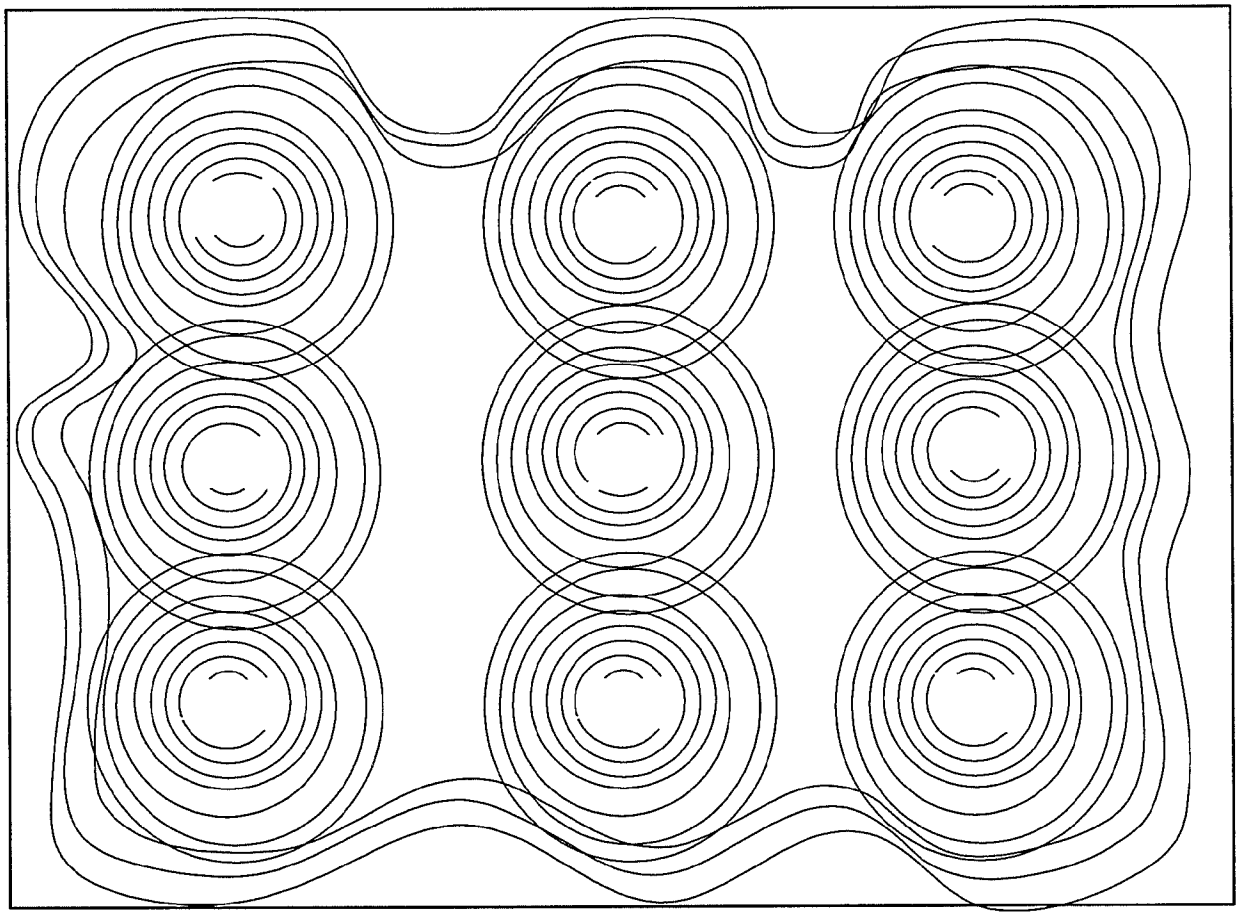
FIG. 4 is a diagram of the electric field pattern of an array of microwave sources.

The horn 18 is configured to provide high gain, low VSWR and relatively wide bandwidth and to serve as an impedance matcher between the waveguide and the free space of the chamber. The forward field is maximized by the matched termination provided by the horn and reflected waves are minimized. In one embodiment using a WR 430 waveguide, the magnetrons operate at 2.45 GHz, and the horns have a beam width of 20 degrees, and a gain of at least 15 dB and a return loss of <−10 dB. The radiation pattern of each horn overlaps the radiation pattern of the other horns of the microwave array as illustrated in FIG. 4 to produce a substantially uniform radiation pattern throughout the volume of the furnace chamber.

The microwave radiation is multi-mode in the chamber and one or more mode stirrers are employed to provide changing mode patterns to maintain uniformity of the electric field in the chamber. A mode stirrer 103 in shown in FIG. 1.

The magnetrons in the illustrated embodiment each have an output power of 1.1 kilowatts and are driven by a power supply which can be individually controlled. The maximum power of the array of nine sources is about 10.8 kilowatts in this embodiment. The array of magnetrons is air cooled by directing air at high velocity onto the cooling vanes of the magnetrons to maintain the magnetrons below 60° C. at 100% power. Cooling air can also be directed to the power supplies to maintain a safe operating temperature. The cooling air is exhausted through one or more vents provided in the furnace housing.

The magnetron array is not limited to nine magnetrons. The number and power output of the magnetrons can vary to achieve an intended power distribution with a high degree of uniformity and power level for the workpieces being processed.

Figure 5:
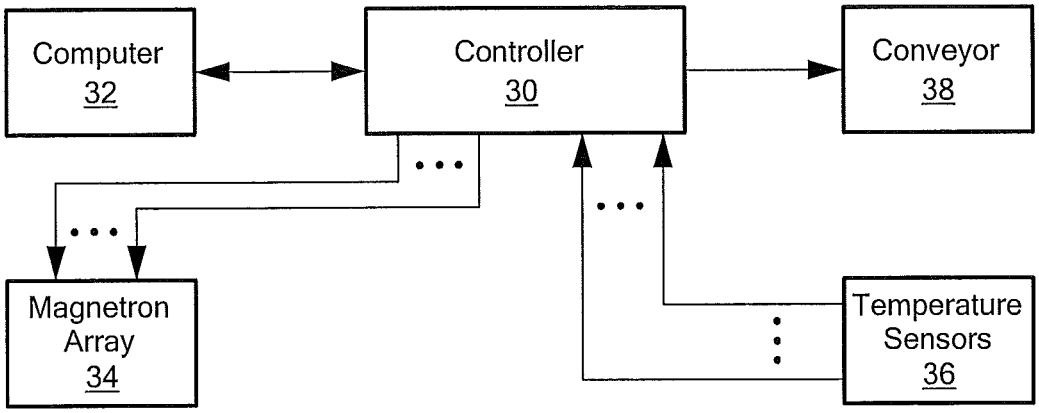
FIG. 5 is a block diagram of a controller for the furnace system.

The control system for the magnetron array is illustrated in FIG. 5. A controller 30 cooperative with a computer 32 receives temperature signals from temperature sensors 36 in the furnace and provides control signals to the magnetron power supplies of the magnetron array 34. The controller can also provide control signals to the conveyor 38 to govern the speed of the conveyor. The power output of each magnetron in the array is individually controllable so that the power level of the array of magnetrons can be tailored to provide uniform radiation or an intended radiation profile in the chamber. As a result of this control, an intended temperature or an intended temperature profile can be maintained in the furnace during an operating cycle. The controller operates in accordance with one or more control algorithms, such as PID (proportional integral derivative) control.

The power output of each magnetron in the magnetron array can be monitored and/or recorded by the apparatus shown in FIG. 3. A bi-directional coupler 11 is provided in each magnetron assembly, for example between waveguides 12 and 14. The coupler provides signals via a switch box 14 to a power meter 15. The coupler for each magnetron is connected in similar manner to power meter 15 via switch box 13. The power meter is operative to display and/or record the power output readings of each magnetron in the array, as selected by use of the switch box 13. The magnetron outputs may be manually selected by manual operation of the switch box. Alternatively, the switching operation may be automated to sequentially read and/or record the power outputs of the magnetrons in the array. The switching can be governed, for example, by the controller 30 of the control system.

Thermal Box and Susceptors

Figure 6:
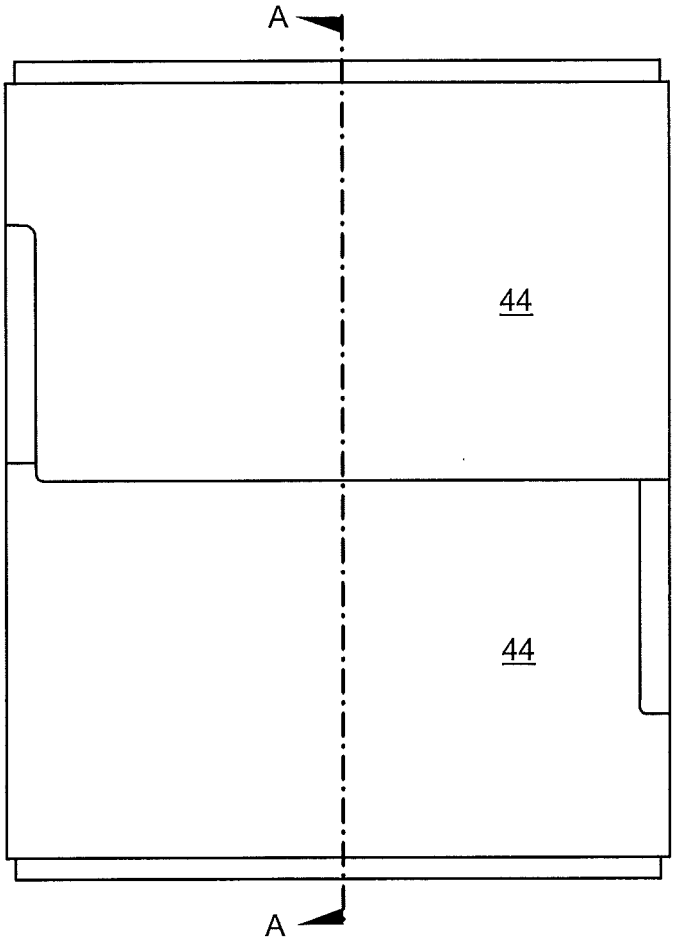
FIG. 6 is a top view of a thermal box.
Figure 7:
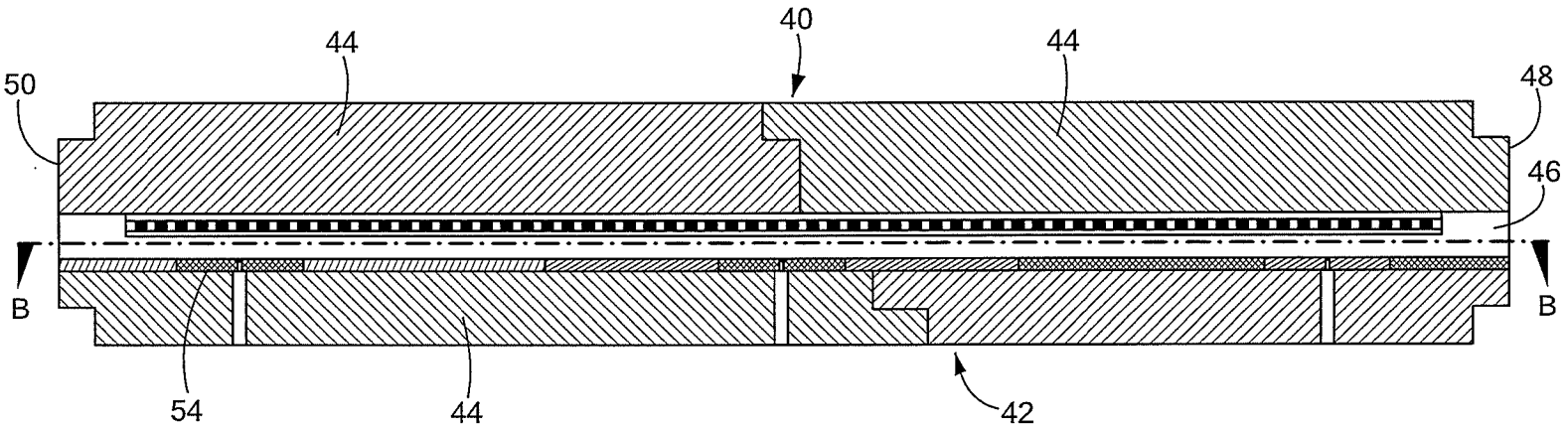
FIG. 7 is a sectional elevation view taken along lines A-A of FIG. 6.
Figure 8:
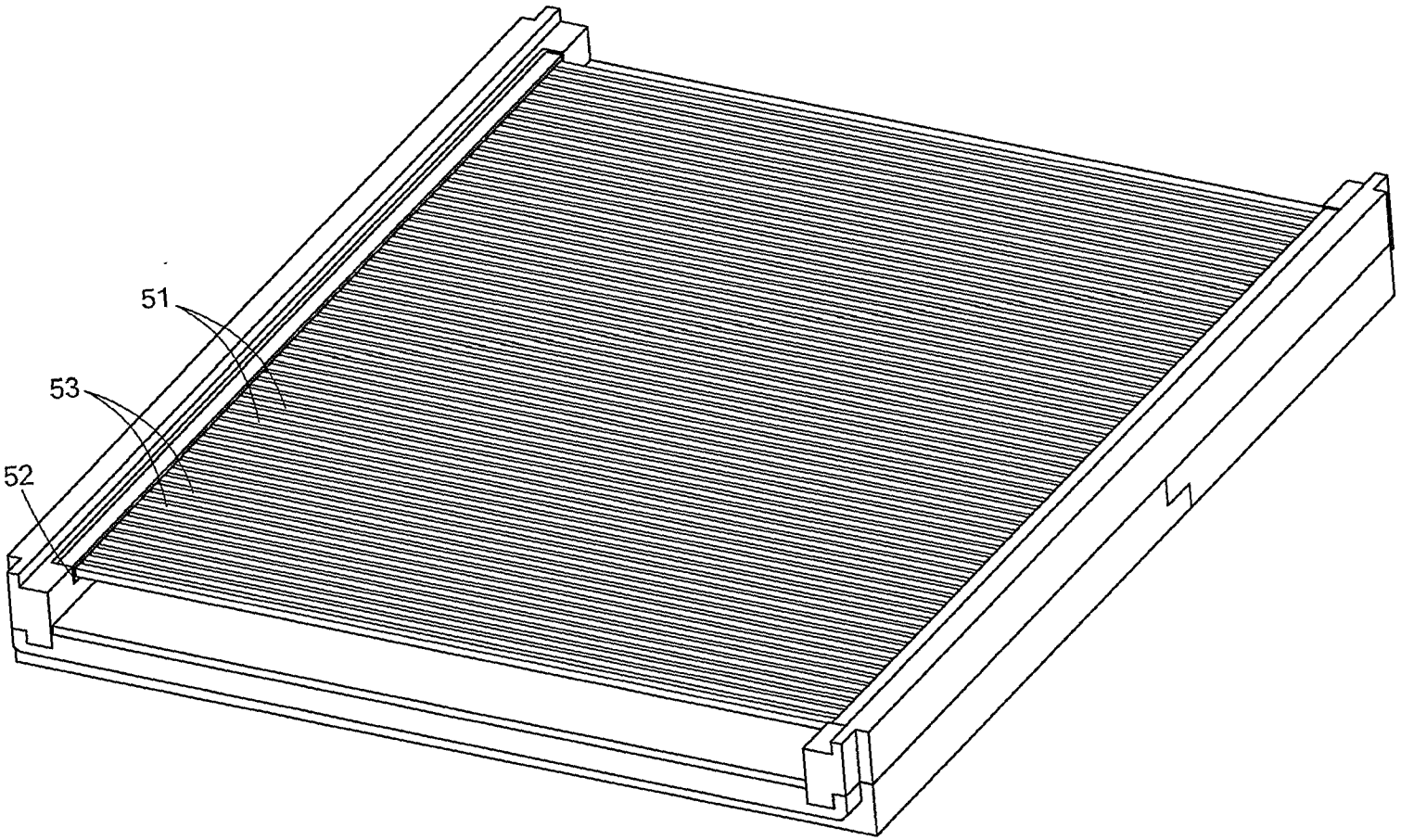
FIG. 8 is a pictorial view of the thermal box.

The thermal box and susceptor rod arrangement is illustrated in FIGS. 6-9. A thermal box is composed of a high purity, high temperature alumina or other material which is transparent or transmissive to microwave energy and opaque to thermal energy at the frequency employed. A typical material is alumina insulating board. The box in the illustrated embodiment has an upper portion 40 and a lower portion 42, each of which is made up of interfitted sections 24 as illustrated in FIGS. 6 and 7. A channel 46 is provided through the box from a first end 48 to a second end 50 for transport of workpieces therethrough.

A plurality of susceptor rods 51 are disposed along the length of the thermal box between the first and second ends. The rods are spaced from each other and quartz rods 53 are disposed between adjacent susceptor rods to maintain the spacing of the susceptor rods along the length of the chamber defined by channel 46. The susceptor rods and quartz rods are supported on shelf areas 52 provided along the respective sides of the chamber. The quartz rods are transparent to microwave energy. The susceptor rods are absorptive of microwave energy and are heated by the microwave energy and radiate heat to the workpieces transported through the chamber. In general, the microwave power is of a level to provide a penetration depth in the susceptor rods of about 50%.

The susceptor rods and spacer elements can be of any shape and size to produce the desired absorption and transmission of microwaves. The rods collectively provide an intended thermal mass to be heated by the microwaves and to radiate in the chamber to heat workpieces in the chamber. The susceptor rod sizes and the spacing between adjacent rods are determined to produce the intended temperature uniformity in the furnace chamber and to achieve acceptable heating efficiency. The efficiency is defined as the amount of heating accomplished for the least amount of power consumed by the magnetron array.

Figure 9:
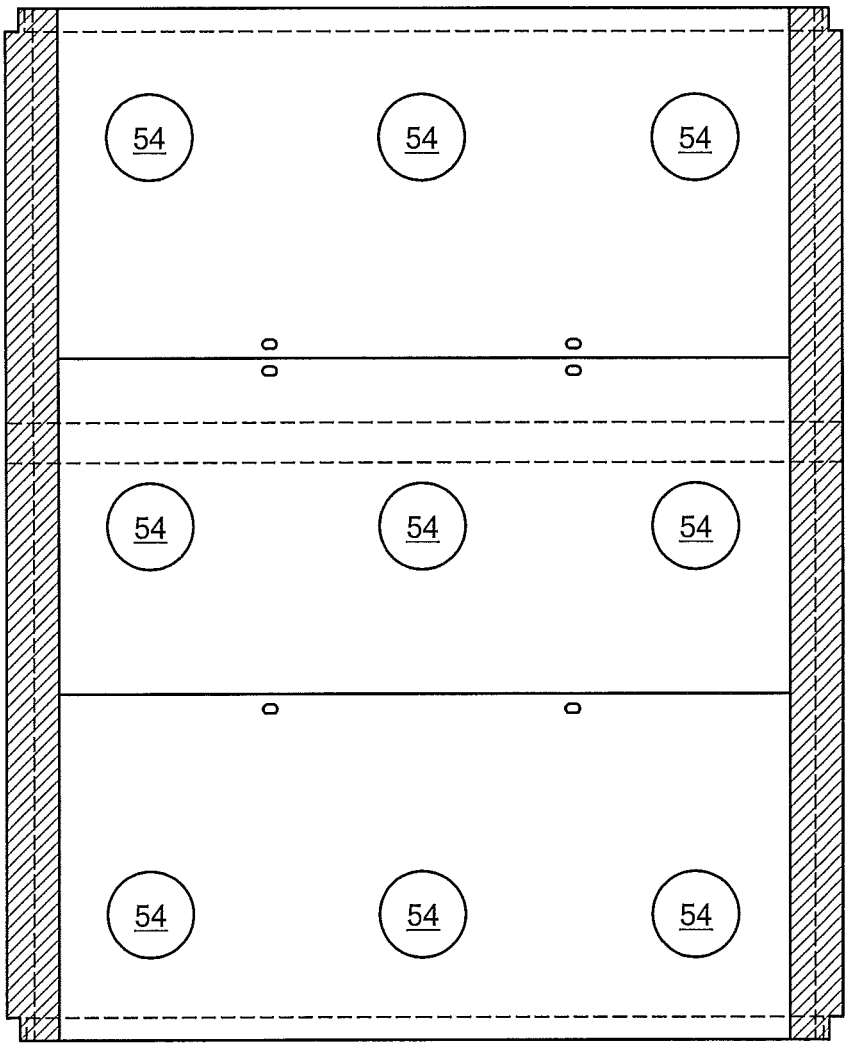
FIG. 9 is a sectional view taken along lines B-B of FIG. 7.

Quartz disks 54 shown in FIGS. 7 and 9 are disposed on the bottom surface of channel 46 generally flush with the bottom surface to protect thermocouples disposed beneath respective disks from direct exposure to the electromagnetic field. A thermocouple tip is retained in a groove of each quartz plate, the thermocouples providing temperature signals to the system controller. The disks 54 may be disposed in a quartz or other suitable plate which provides a smooth surface on which conveyor belt can ride.

The susceptor rods are of a size and spacing to achieve uniformity of heating and balance between the microwave and the radiative heating of the workpieces.

The susceptors are composed of high purity high temperature composite ceramic material having high microwave absorption, high mechanical strength and thermal shock resistance, low oxidation and low chemical degradation at high operating temperatures. Suitable materials are a ceramic material of the group consisting of SiC, $SiO_2$, $Fe_2O_3$ $Si_3N_4$, and $Al_2O_3$.

Lower Temperature Operation

For lower operating temperatures typically less than about 600° C., the susceptors are operative mainly to control or modulate the microwave field to produce more uniform microwave heating of workpieces in the furnace chamber. At these lower temperatures, the susceptors do not contribute much radiant heating of the workpieces.

The susceptors at these lower temperatures contribute heat to the volume of air in the furnace chamber which is stirred or moved by convective currents caused by conveyor belt movement, and the heated convective air provides some heating of the workpieces.

Two Stage Chokes

Figure 10:
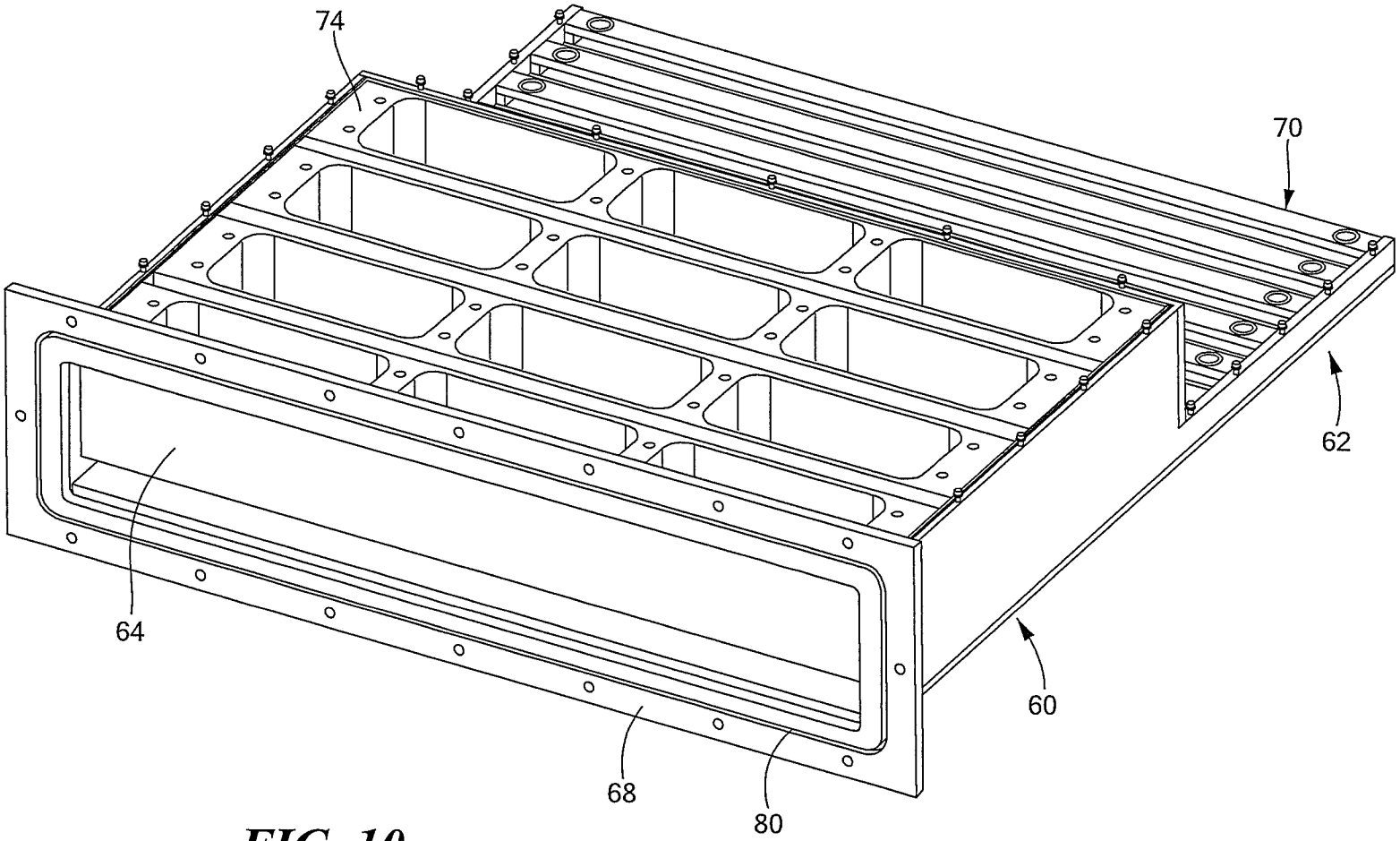
FIG. 10 is a pictorial view of a choke in accordance with the invention.
Figure 11:
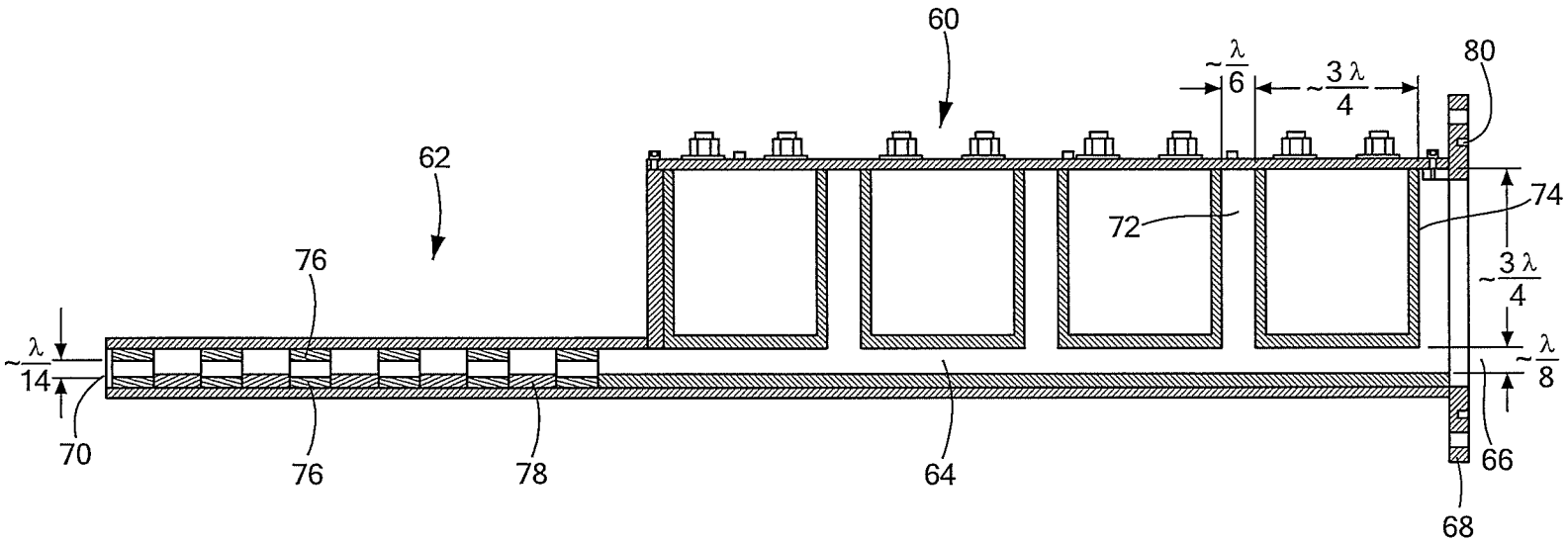
FIG. 11 is a sectional elevation view of the choke of FIG. 10.

The two stage microwave chokes 106 and 108 (FIG. 1) are illustrated in FIGS. 10 and 11. Each choke includes a reflective section 60 and an absorptive section 62. A channel 64 is provided through the length of the choke from one end 66 which is attached via a flange 68 to the furnace housing, and an opposite end 70 which is open to the atmosphere. The channel 64 is aligned with the furnace chamber 111. Conveyor belt 110 (FIG. 1) extends through the channel 64 of each choke and the furnace chamber for conveying workpieces through the furnace.

The reflective section 60 is operative to attenuate the microwave field by destructive interference. Channels 72 are provided orthogonal to channel 65 and which are configured and dimensioned to reflect microwave energy from channel 64 back into that channel 180° out-of-phase with the incident energy to thereby cancel or substantially attenuate the microwave field in channel 64. In the illustrated embodiment, the reflective channels 72 are formed by the spaces between pot shaped elements 74, but the reflective channels can be provided by many other constructions.

The absorptive section 62 is operative to further attenuate the microwave field and includes in the illustrated embodiment, rectangular rods or bars 76 extending across the width of channel 64 and disposed at the top and bottom of the channel. The bars 76 are composed of a microwave absorptive material which may the same material used in the susceptor rods or other composite or pure material having the requisite characteristics. Spacers 78 are provided between the bottom absorptive bars 76 and serve as spacers or fillers to provide a substantially continuous floor in section 62 of the choke. The spacers 78 are typically made of quartz. The substantially continuous floor provides a smooth support for the conveyor belt being driven through channel 64 of the choke. The mounting flange 68 includes a groove 80 in which a metal or other conductive gasket is disposed to prevent microwave leakage through the mounting flange attached to a furnace wall, as per se known in the microwave art. The dimensions in relation to wavelength for a typical embodiment are as shown in FIG. 11.

Radiation is reduced at the end of the reflective stage by about 90%. Microwave energy is further attenuated in the absorptive stage resulting in EMI leakage from end 70 of the choke of about 5 mw/cm$^2$ which is very low leakage and well below applicable standards for leakage from microwave sources.

The length of the choke stages and the number of reflective channels in the reflective stage and absorbing elements in the absorptive stage is determined to result in the desired attenuation of EMI leakage from the exit end of the choke.

Conveyor Belt

The conveyor belt in the illustrated embodiment is a woven metal belt which itself can be of known construction. The metallic wires of the belt provide a sufficiently small surface area in the microwave chamber to not adversely interfere with microwave performance. Presence of the metallic belt is taken into account in tuning of the microwave array to minimize unwanted reflections which could interfere with intended heating performance and which could interfere with or be damaging to the magnetron sources. In alternative embodiments, a non-metallic conveyor belt can be employed for transport of workpieces through the furnace. Non-metallic conveyor belts are shown for example in co-pending US application BTU-197XX. Other conveyor systems can be utilized such as roller or pusher types to suit different product configurations and produce weights.

The invention is not to be limited to what has been particularly shown and described but is intended to encompass the spirit and true scope of the appended claims.

What is claimed is:

1. A furnace system for hybrid microwave and radiant heating of workpieces transported through a furnace chamber, the system comprising:

a housing having an inlet end and an outlet end;

a chamber having a width and a length in the housing disposed between the inlet end and outlet end and having one or more zones;

a conveyor for transporting workpieces through the furnace chamber from the inlet end to the outlet end;

a plurality of susceptor rods each composed of high temperature microwave absorptive material, the susceptor rods being disposed across the width of the chamber in at least one zone thereof, and spaced along the length of the chamber in the at least one zone thereof and positioned above the conveyor to define a chamber through which the workpieces are transported;

a plurality of microwave transparent elements each disposed between adjacent ones of the spaced susceptor rods across the width of the chamber to maintain the spacing of the susceptor rods along the length of the chamber;

a plurality of microwave sources arranged to provide uniform microwave radiation in the chamber to uniformly heat workpieces transported through the chamber by the conveyor and to provide uniform heating of the plurality of susceptors;

the plurality of susceptors upon microwave heating by the plurality of microwave sources providing uniform radiant heating of the workpieces transported through the chamber by the conveyor;

a controller operative to control the power of the plurality of microwave sources to provide an intended thermal profile in the chamber;

a microwave choke at the inlet end of the furnace chamber and a microwave choke at the outlet end of the furnace chamber and operative to minimize microwave leakage from the furnace chamber.

2. The furnace system of claim 1 wherein the plurality of susceptor rods each have:

high microwave absorption;

high mechanical strength;

high thermal shock resistance;

low oxidation at elevated temperature; and low chemical degradation.

3. The furnace system of claim 1 wherein each of the plurality of susceptor rods is composed essentially of a ceramic material of the group consisting of SiC, $SiO_2$, $Fe_2O_3$, $Si_3N_4$, $Al_2O_3$, MgO and $Y_2O_3$.

4. The furnace system of claim 1 wherein the plurality of microwave sources provides a penetration depth in the plurality of susceptors of about 50%.

5. The furnace system of claim 1 including at least one mode stirrer in the chamber.

6. The furnace system of claim 1 wherein each of the plurality of microwave sources are tunable to provide in concert with the other ones of the plurality of microwave sources an intended electric field in the chamber.

7. The furnace system of claim 6 wherein each of the plurality of microwave sources includes a magnetron.

8. The furnace system of claim 1 including at least one temperature sensor for sensing temperature in the chamber and providing temperature signals to the controller.

9. The furnace system of claim 1 wherein the controller is also operative to control the speed of the conveyor.

10. A hybrid heating assembly comprising:

an insulated housing having a chamber therein in which one or more workpieces can be thermally processed, the insulated housing being composed of a material which is microwave transparent;

a plurality of susceptor rods disposed in the insulated housing above the chamber, each of the rods extending across the width of the chamber and the plurality of rods being disposed in spaced relation along the length of the chamber, each of the susceptors composed of a high temperature microwave absorptive material;

a plurality of microwave transparent elements each disposed between adjacent ones of the spaced susceptor rods across the width of the chamber to maintain the spacing of the susceptor rods along the length of the chamber;

a plurality of microwave sources arranged to provide uniform microwave radiation in the chamber of the insulated housing to uniformly heat the plurality of susceptor rods in the chamber and to uniformly heat workpieces in the chamber.

11. Apparatus for use in a microwave furnace comprising:

a housing of thermally insulative and microwave transmissive material enclosing a chamber for containing at least one workpiece;

a plurality of susceptor rods each composed of high temperature microwave absorptive material, the rods disposed across the width of the chamber and spaced along the length of the chamber; and a plurality of microwave transparent elements each disposed between adjacent ones of the susceptor rods across the width of the chamber- to maintain the spacing of the susceptor rods along the length of the chamber.

12. The apparatus of claim 11 wherein the housing has shelf areas on respective sides of the chamber;

and wherein the susceptor rods and microwave transparent elements are supported on the shelf areas.

* * * * *